US007107654B2

(12) United States Patent
Byers

(10) Patent No.: US 7,107,654 B2
(45) Date of Patent: Sep. 19, 2006

(54) TIE STRAP ASSEMBLY AND FASTENING DEVICE

(75) Inventor: Gary L. Byers, Columbia Falls, MT (US)

(73) Assignee: Locan Properties, LLC, Kalispell, MT (US)

( * ) Notice: Subject to any disclaimer, the term of this patent is extended or adjusted under 35 U.S.C. 154(b) by 53 days.

(21) Appl. No.: 10/849,682

(22) Filed: May 19, 2004

(65) Prior Publication Data

US 2005/0257348 A1 Nov. 24, 2005

(51) Int. Cl.
*B65D 67/02* (2006.01)
*B65D 63/00* (2006.01)

(52) U.S. Cl. ..... 24/16 PB

(58) Field of Classification Search ..... 24/16 R, 24/17 R, 18, 17 AP, 17 B, 27, 115 R, 129 R, 24/130, 131 R, 129 B, 129 C; 248/65, 67.7, 248/68.1, 71, 73, 74.1, 74.3
See application file for complete search history.

(56) References Cited

U.S. PATENT DOCUMENTS

| | | | | | |
|---|---|---|---|---|---|
| 340,239 | A | * | 4/1886 | Palmer | 24/129 R |
| 468,819 | A | | 2/1892 | McAnarney | |
| 767,204 | A | | 8/1904 | Carpenter | |
| 1,156,565 | A | | 10/1915 | Timmerman | |
| 1,181,767 | A | | 5/1916 | Houdyshell | |
| 1,246,864 | A | | 11/1917 | Brion | |
| 1,441,737 | A | | 1/1923 | Mickelson | |
| 3,048,906 | A | * | 8/1962 | Patterson | 24/16 R |
| 3,353,232 | A | | 11/1967 | Brownson | |
| 3,953,911 | A | | 5/1976 | Fishack | |
| 4,188,871 | A | | 2/1980 | Teachout | |
| 4,270,247 | A | | 6/1981 | Freedom | |
| 4,335,490 | A | | 6/1982 | Teachout | |
| 4,569,108 | A | | 2/1986 | Schwab | |
| 4,910,835 | A | * | 3/1990 | Carpenter | 24/129 R |
| 5,199,135 | A | | 4/1993 | Gold | |
| 5,205,687 | A | * | 4/1993 | Boyland | 24/130 |
| 5,210,912 | A | * | 5/1993 | Hoefkes | 24/131 R |
| D376,095 | S | * | 12/1996 | Curtis | D8/356 |
| 5,625,925 | A | * | 5/1997 | Richards | 24/129 B |
| 5,772,371 | A | | 6/1998 | Ackerman | |
| 5,784,763 | A | * | 7/1998 | Cassidy | 24/130 |
| 5,893,456 | A | | 4/1999 | Bosmans | |
| 5,906,033 | A | * | 5/1999 | Mukaiyama | 24/589.1 |
| 6,543,094 | B1 | | 4/2003 | D'Addario | |
| 6,913,301 | B1 | * | 7/2005 | Gotz et al. | 24/598.5 |

* cited by examiner

*Primary Examiner*—Robert J. Sandy
*Assistant Examiner*—Ruth C. Rodriguez
(74) *Attorney, Agent, or Firm*—Dowrey Rickards PLLC

(57) ABSTRACT

A tie strap assembly for encircling and securing bundles of articles or discrete items including a looped tie strap or elastic band and a coupler for engaging opposite ends of the strap. The coupler includes an elongated shank having hook shaped arms on one end and an open ring on the opposite end. Protrusions are provided on the ring for capturing one end of the strap and keeper arms protrude from the shank to aid in holding the opposite end of the strap on the hook shaped arms. The ring has an open center for hanging the assembly for storage.

24 Claims, 6 Drawing Sheets

FIG. 3
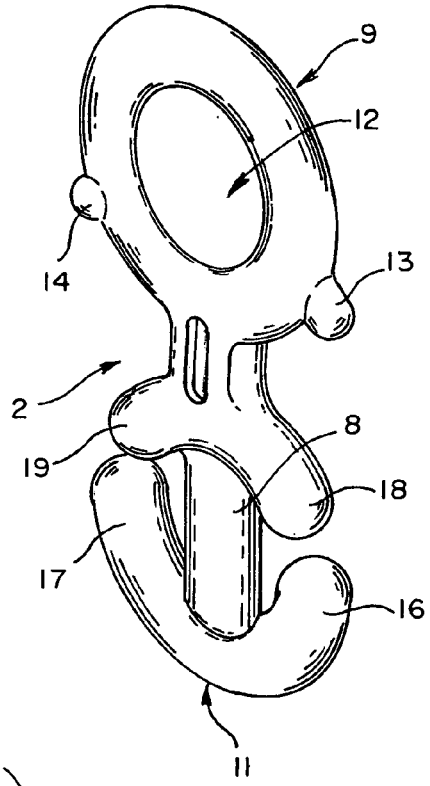
FIG. 4
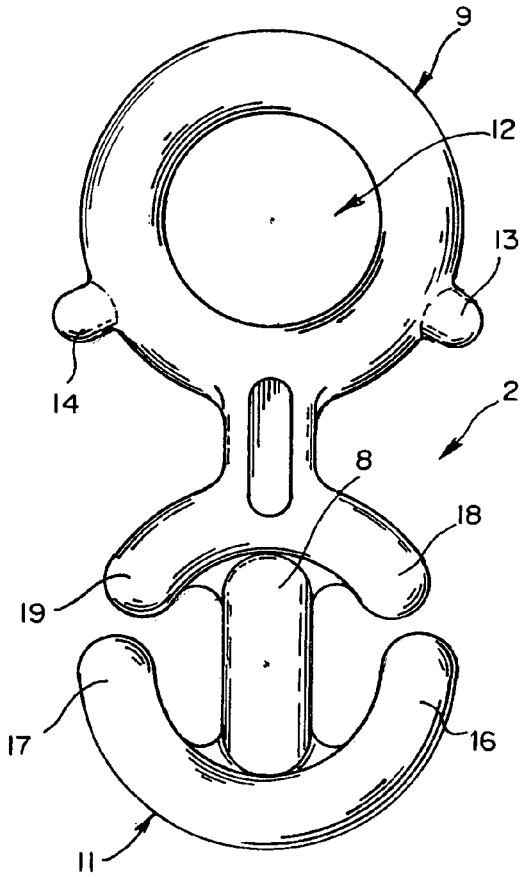
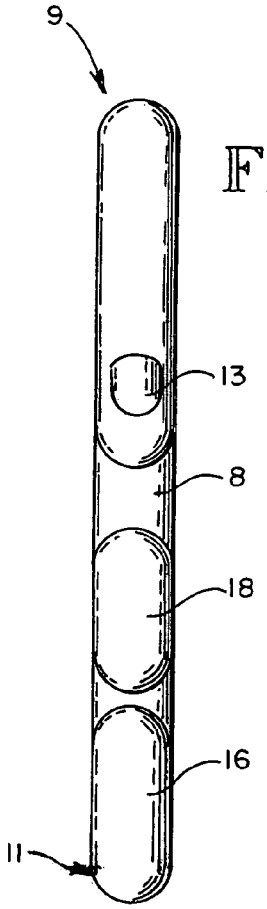
FIG. 5
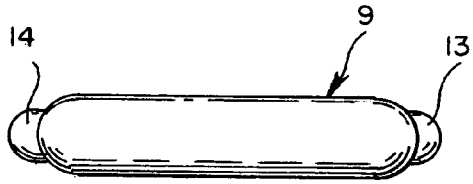
FIG. 6
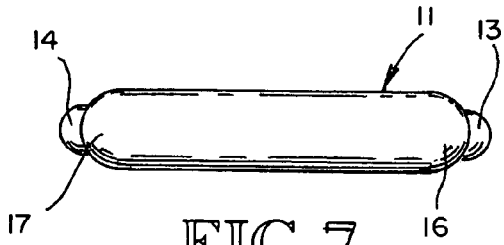
FIG. 7

TIE STRAP ASSEMBLY AND FASTENING DEVICE

BACKGROUND

1. Field of the Invention

The present invention relates to tying strap assemblies and fastening devices for bundling such articles as coiled garden hoses, electric cords and cables, electrical wire bundles as well as for tie wrapping a wide variety of variously shaped discrete articles. More particularly, the present invention relates to a coupling device used in combination with a strap assembly such as but not limited to an elastic band.

2. Description of the Prior Art

The present invention provides significant improvements in tie strap assemblies and coupler devices of the double hook type. With the present invention, the tie strap may comprise a single flexible strand having looped connector end sections, a simple looped or endless strand or a conventional elastic band or loop such as a rubber band. The coupler device may be manufactured utilizing any suitable material, preferably a single molding of such materials as metal, or rigid, semi-rigid or pliable plastics. In this sense, the improved assembly and coupler is extremely inexpensive to manufacture with readily replaceable parts. Since the coupler unit and strap combination can be made non-rigid or deformable the system becomes adaptable to a wide variety of uses and environments. Examples of the double hook type coupling devices and tie strap assemblies are found in the following listed U.S. patents:

| U.S. Pat. No. | Patentee |
|---|---|
| 468,810 | McAnarney |
| 767,204 | Carpenter |
| 1,246,864 | Brion |
| 1,441,737 | Mickelson |
| 3,353,232 | Brownson |
| 4,569,108 | Schwab |

All of these patents require some sort of lacing or tying of either elastic or rope type bands on one end or the other of the coupler device and hence are cumbersome to assemble. Additionally these devices do not provide any means for adjustably positioning the tie strap on the coupler to adjust the tension. The structures do not incorporate any effective means in the coupling device for hanging or storing the articles encircled by the tie strap.

U.S. Pat. No. 5,893,456 to Bosmans and U.S. Pat. No. 6,543,094 to D'Addario are examples of tie strap assemblies wherein the tie strap is either molded integral with or permanently connected to the coupler device.

The following listed patents are exemplary of various designs of tie strap assemblies and coupling devices. These patents are of interest to illustrate the development of the art:

| U.S. Pat. No. | Patentee |
|---|---|
| 1,156,565 | Timmerman |
| 1,181,767 | Houdyshell |
| 3,953,911 | Fishack |
| 4,188,871 | Teachout |
| 4,270,247 | Freedom |
| 4,335,490 | Teachout |

-continued

| U.S. Pat. No. | Patentee |
|---|---|
| 5,199,135 | Gold |
| 5,772,371 | Ackerman |

SUMMARY

The tie strap assembly and coupling device of the present preferred embodiments includes a novel coupler device and a flexible tie strap. The coupler device includes an enlarged head in the shape of a ring or loop in the preferred embodiment which functions both as a releasable connector for one end of the strap and a hanger element which is available for storing items encircled and held by the strap. The head or ring may be equipped with projecting bosses for restraining one end of the strap in engagement with the coupler device. An elongated shank portion is connected to the ring at one end and is connected at its other or lower end portion to a curved double hook. The hook includes curved arms extending laterally and upwardly to provide a connection point for the opposite end of the strap. Downwardly and laterally outwardly extending keeper arms are attached to the shank along its length and cooperate with the curved arms of the hook to guide and hold the end of the strap within the hook formation. The flexible tie strap may comprise any form of flexible single strand or endless band, preferably formed from an elastic material such as rubber or synthetic elastic material having loop sections at its opposite ends. In one modification, additional bosses and projecting connector elements are formed on both the upper ring and the lower hook portion to adapt the coupler device for use in clasping and holding smaller wires such as computer or other electrical wires or cords. Provisions are also made in the contours of the coupler device to facilitate connection and disconnection of the elastic band when the coupler device is mounted against a wall surface or other storage position. In yet another modification, the loop or ring is rendered sufficiently flexible to permit the insertion and snap lock mounting of a gusseted hanger ring which adapts the coupler device for removably mounting by a screw, nail or other fastener. For marketing and distribution purposes, the open ring type coupler may be provided with a removable display-card mounting disc within the ring at the time of molding. The disc may be removed and discarded when the coupler is put into use.

BRIEF DESCRIPTION OF THE DRAWINGS

FIG. 2 is a perspective view of the tie strap assembly encircling discrete elements such as boards or the like;

FIG. 3 is a perspective view of the coupler device;

FIG. 4 is a front elevational view of the coupler device;

FIG. 5 is side elevational view of the coupler device;

FIG. 6 is a top plan view of the coupler device;

FIG. 7 is a bottom plan view of the coupler device;

FIG. 11 is a perspective view of a second embodiment of the coupler device configured for use with smaller coiled items such as computer cables and the like;

DETAILED DESCRIPTION OF THE PREFERRED EMBODIMENTS

Figure 1:
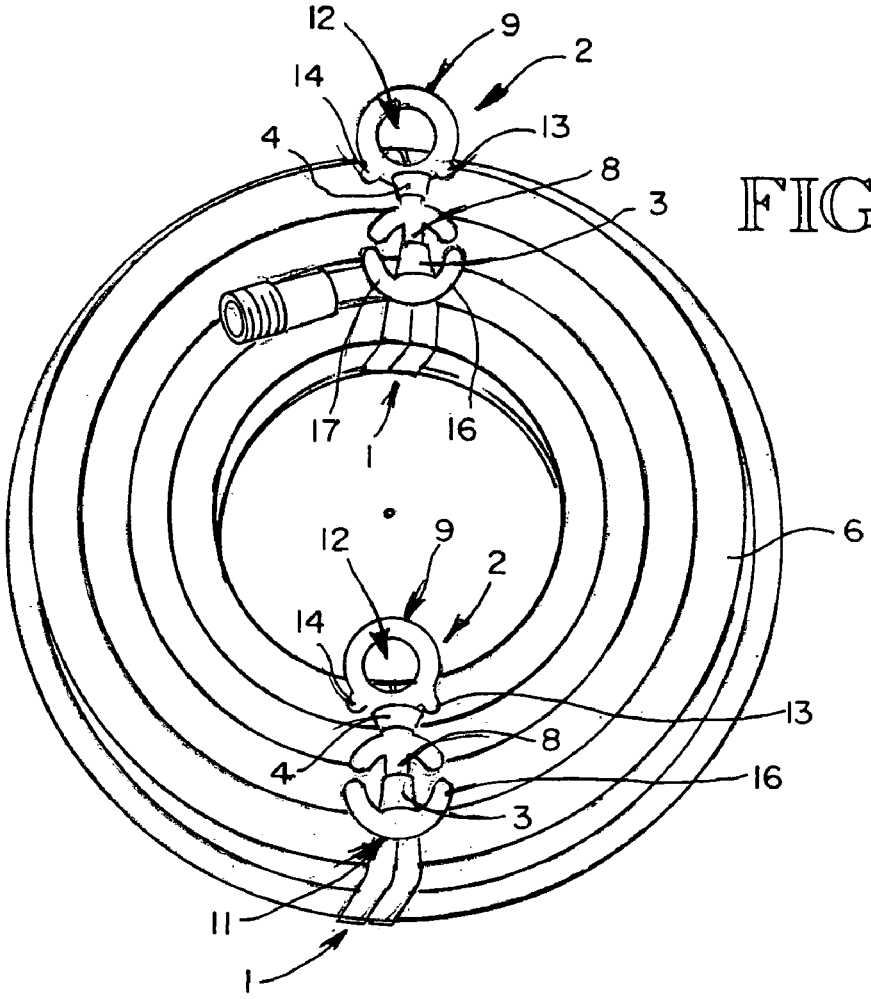
FIG. 1 is a perspective view of the tie strap assembly engaged for holding a coiled item such as a garden hose.
Figure 2:
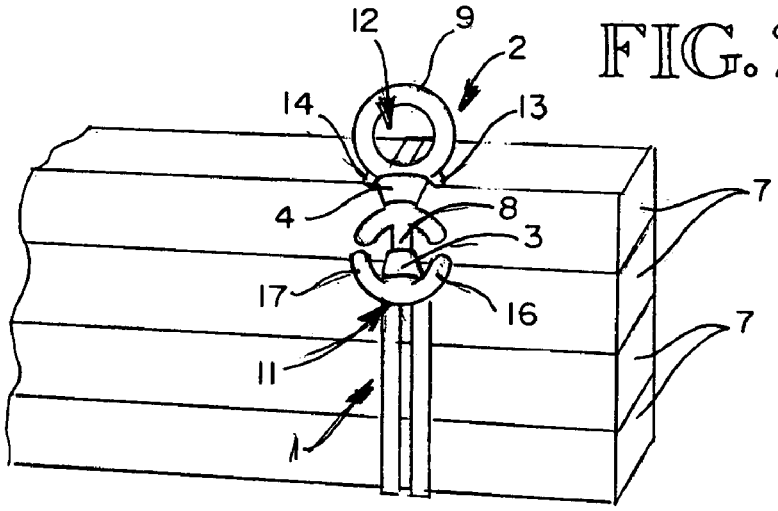
Figure 10:
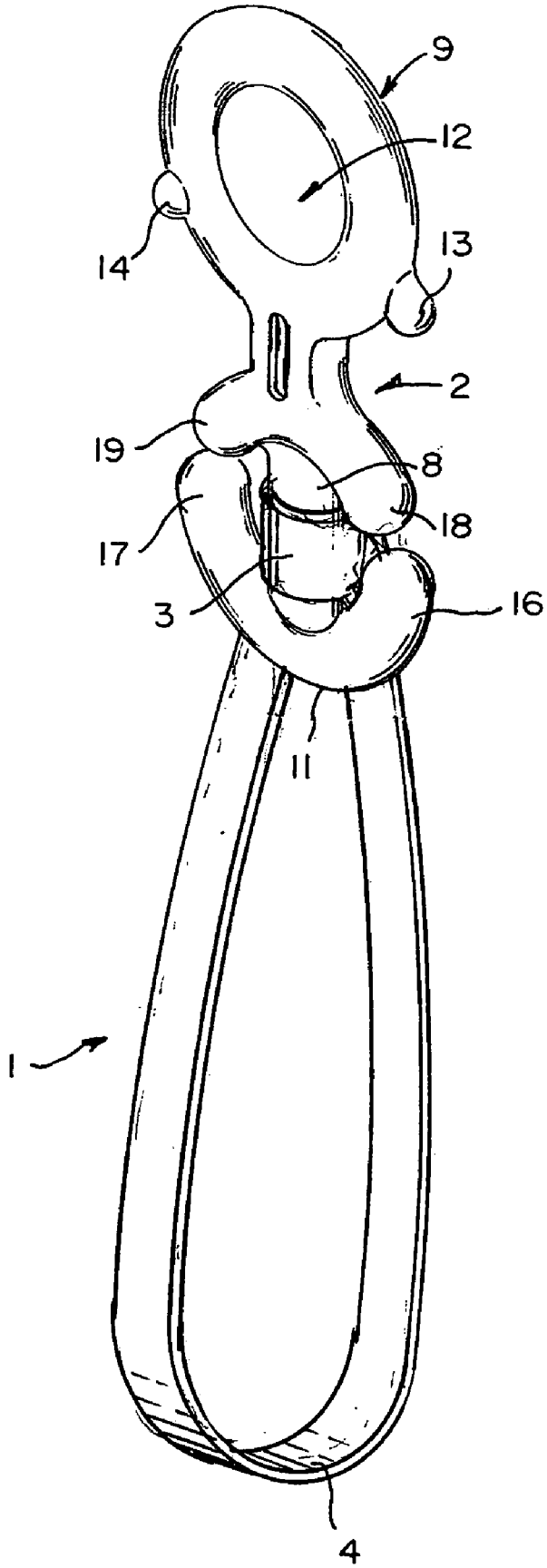
FIG. 10 is a perspective view showing the coupler device and tie strap with the tie strap connected at one end to the double hook formation.
Figure 11:
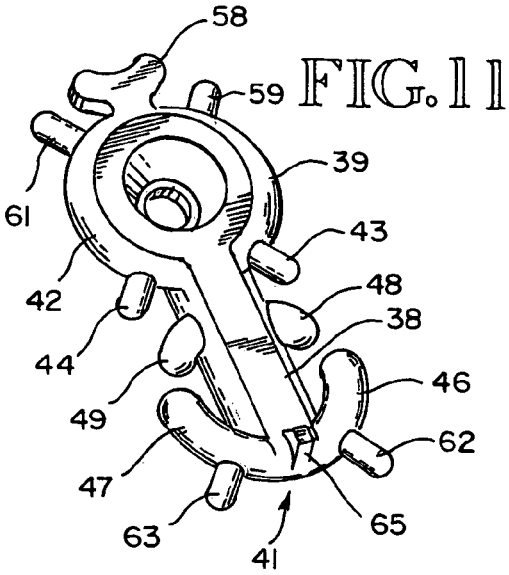
Figure 12:
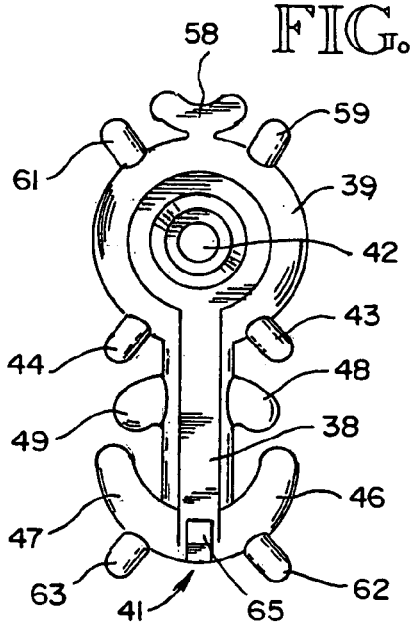
FIG. 12 is a front elevational view of the FIG. 11 embodiment.
Figure 13:
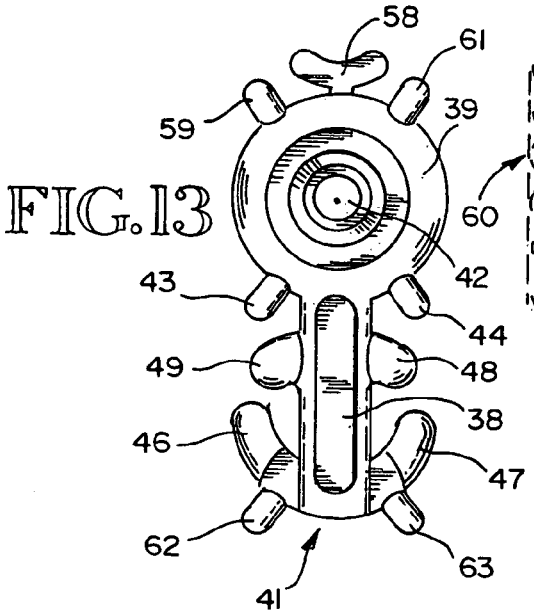
FIG. 13 is a rear elevational view of the FIG. 11 embodiment.

Referring to FIGS. 1, 2 and 10, the tie strap assembly system includes an endless preferably elastic strap 1 and a coupler device, indicated generally at 2, which functions to connect the opposite loop ends 3 and 4 of the strap together in order to secure a number of loose items within the wrap of the elastic strap 1. As illustrated in FIGS. 1 and 2, the tie strap assembly may be used to secure such items as a coiled garden hose 6, shown in FIG. 1 or a number of discrete items 7 as illustrated in FIG. 2. It will be understood, of course, that the strap assembly is not limited in its use and would be equally suitable for packages, such items as skis or as support ties for instance, such as used in tree and plant culture or any other conceivable use.

Although not so limited, the coupler device 2 is preferably formed from a relatively soft and slightly bendable materials such as injection molded plastics. The strength and dimensions of the various parts of the coupler device may be altered, depending upon the design parameters desired for the coupler for any particular use. Referring more particularly to FIGS. 3–7, the coupler device 2 includes an elongated central shank 8 with a loop ring 9 at one end and a double hook fastener 11 at the other. As aforementioned, the loop ring 9 provides a connection point for one looped end of the elastic band or strap 1 and the double hook fastener 11 provides a connection point for the opposite looped end of the band, as shown in FIGS. 1, 2 and 10.

As shown most clearly in FIGS. 1 and 2, the loop ring 9 may be circular in elevation with an open central area 12 for purposes to be described. Although the loop ring 9 is shown in circular configuration, it will be understood that it may be formed in any other configuration which will provide an enlarged end of the shank 8 over which the looped end 4 of the band 1 may be engaged in a holding fashion as illustrated. In order to insure retention of the strap over the ring 9, bosses such as those shown at 13 and 14 are located on the bottom half of the ring 9, preferably spaced 180° or more apart as illustrated clearly in FIG. 4. These bosses may be formed integral with the ring 9 during molding and may take any form suitable for preventing the looped end 4 of the band from slipping off of the ring 9. With the open center and closed ring 9 oriented so as to be above the looped end 4 of the strap 1 as shown in FIG. 1 it is free to function as a hanger for storing the items bound by the elastic band 1.

The hooked fastener 11 may be formed integral with the body of the coupler device during molding and comprises laterally outwardly and upwardly extending curved arms 16 and 17. Although the arms 16 and 17 are shown as round in cross section and in curved configuration, it will be understood that other shapes may be utilized such as variations in cross section and straight members, as long as they are directed outwardly and upwardly so as to engage the strap end 3 as shown in FIGS. 1, 2 and 10. Also, although shown as connecting with the terminal end of the shank 8, the arms need only be located proximate the bottom end of the shank, leaving a sufficient extent of the shank between the arms and the ring 9. In the embodiment illustrated, the approximate mid portion of the shank is provided with outwardly and downwardly projecting keeper arms 18 and 19. Sufficient clearance is allowed between the terminal ends of the keeper arms 18 and 19 and the arms 16 and 17 to allow the strap to be passed therebetween to position the end 3 of the strap about the shank 8 as shown in FIG. 10. The keeper arms 18 and 19 may also be used to hold the opposite end 4 of the strap if additional tension is required in the strap from that provided by engaging the strap directly beneath ring 9 as shown in FIGS. 1 and 2.

Figure 8:
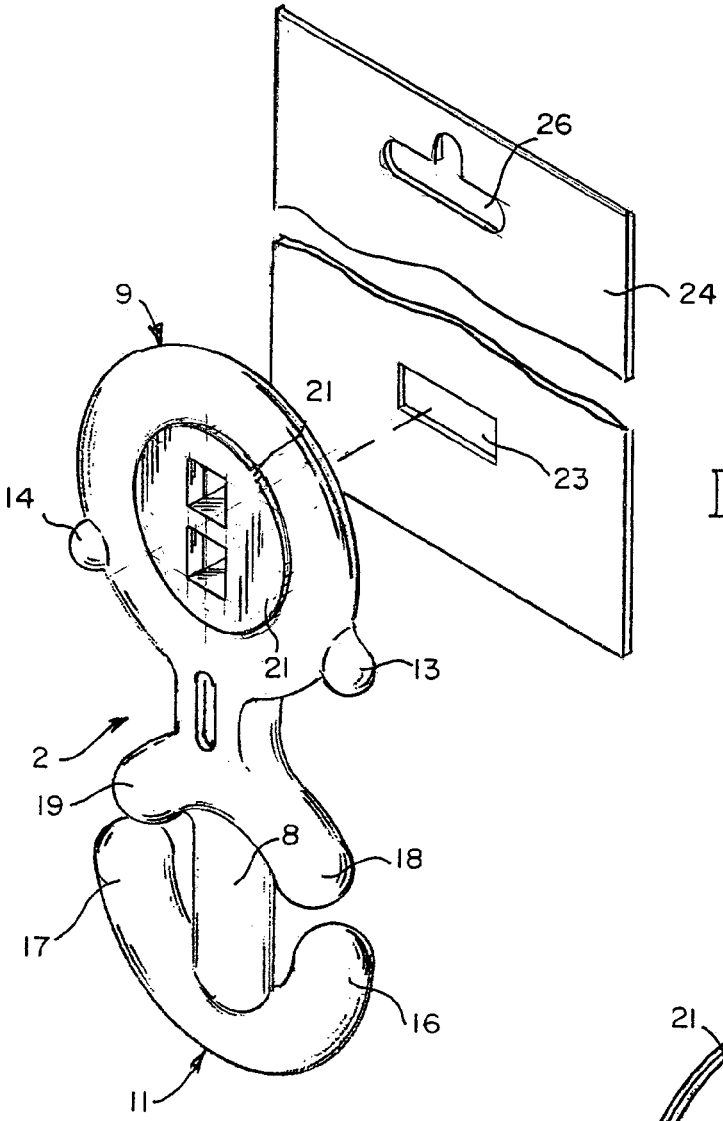
FIG. 8 is an exploded perspective view illustrating a removable display-card mounting disc molded into the central section of the coupler ring.
Figure 9:
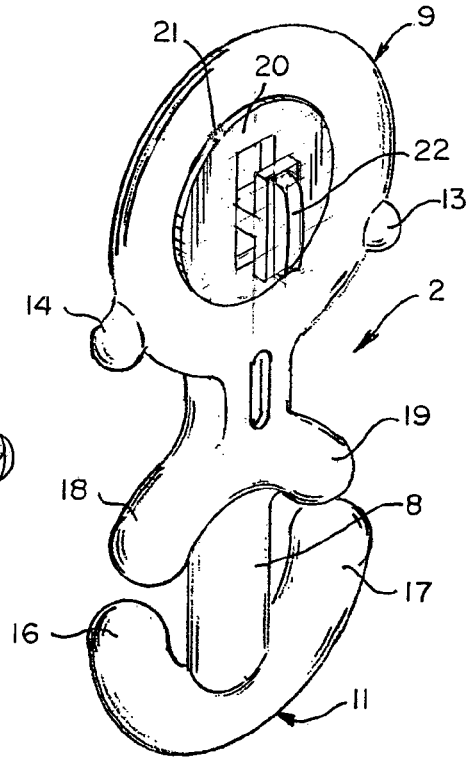
FIG. 9 is a perspective view of the opposite side of the coupler device of FIG. 8.

At the time of molding the coupler device, provision may be made for temporarily attaching the coupler to a display medium such as a display card as illustrated in FIGS. 8 and 9. A common form of marketing display for articles such as the present coupler device is that of temporarily attaching one or more of the articles to a display card or vehicle which is then placed on a suitable display rack available to customers. As shown in FIG. 8, a removable hanger disc 20 may be formed in the opening 12 of the ring 9. The disc 20 may be connected to the inside of the ring surface by very thin break-away connectors such as one or more frangible tabs 21, allowing the disc to be easily removed from the ring and discarded. In the preferred embodiment, disc 20 is provided with a lug 22 spaced from the surface of the disc and rigidly connected thereto. The lug 22 will be sized and configured to engage a slot 23 in marketing display-card 24 which may be of any desired design and which will usually include a slotted opening 26 for engaging a display rack. It will be understood that the display card 24 may be of any known design, the details of which form no part of the present invention. Although the display card shown in FIG. 8 includes only one slot 23 for receiving a lug 22, it will understood that the card 24 may be designed to hold any desired number of coupler devices and may also carry means (not shown) for accommodating straps or elastic bands utilized in the tie strap assembly.

Figure 14:
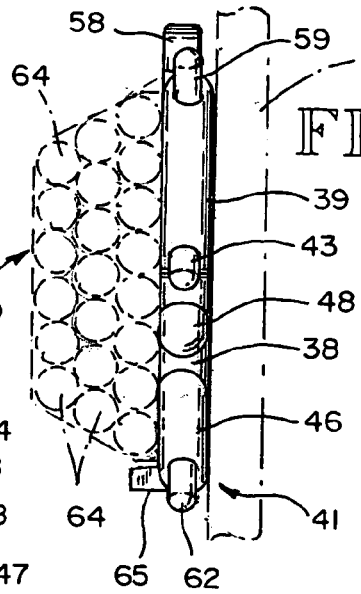
FIG. 14 is a side elevational view of the FIG. 11 embodiment mounted to a wall surface.
Figure 15:
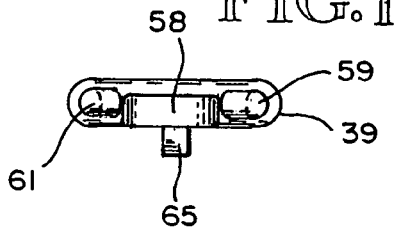
FIG. 15 is a top plan view of the FIG. 11 embodiment.
Figure 16:
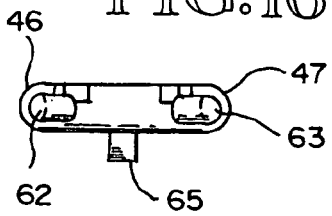
FIG. 16 is a bottom plan view of the FIG. 11 embodiment.

FIGS. 11–16 illustrate a second embodiment of the present invention which is particularly adapted for use in bundling small electrical cords such as computer wires and the like. As previously described relative to the FIGS. 1–10 embodiment, the coupler of FIGS. 11–16 includes the elements described, including an elongated shank portion 38 having a loop ring 39 on its upper end and a double hook fastener 41 on the lower end, as illustrated in the drawings. The hook fastener includes hook arms 46 and 47 and the loop ring 39 is provided with bosses 43 and 44 which correspond in function to the bosses 13 and 14 of the FIGS. 1–10 embodiment. Likewise the shank 38 is provided with keeper arms 48 and 49 corresponding in function to the keeper arms 18 and 19 of the FIG. 1–10 embodiment. It will be understood that the functions of the loop ring 39 and bosses 43–44 as well as the hook fastener 41 and keeper arms 48–49 are identical to the functions described for the corresponding elements in the FIGS. 1–10 embodiment for the purpose of securing the opposite ends of an elastic band used to encircle the items to be held. In addition to these functions, the coupler of the FIGS. 11–16 embodiment is designed to also be wall mounted on a surface such as the wall 50 by means of a nail or screw fastener or the equivalent extending through the central opening 42 of the ring 39. A cleat shaped strap anchor 58 extends upwardly from the top side of the ring 38 and is offset from the central plane of the coupler body as illustrated in FIG. 14 so as to be spaced from the wall surface. Thus, when the coupler is wall mounted, a flexible band, shown in dotted lines at 60 in FIG. 14, may be passed about the cleat 58 with sufficient space being provided between the cleat and the wall surface to allow attachment of the band. The band is prevented from slipping downwardly on the ring 39 by means of the keeper bosses 59 and 61. The band or strap 60 is then passed about the bundle of wires 64 in this instance and its opposite end engaged upon the lugs 62 and 63. If desired, a lug or other protrusion 65 may be formed on the face of the coupler to assist in holding the bundle of wires in place thereon. This relationship is illustrated in FIG. 14. The band or strap 60 is thus located on the opposite face of the coupler from that previously described when used in this mode.

Figure 17:
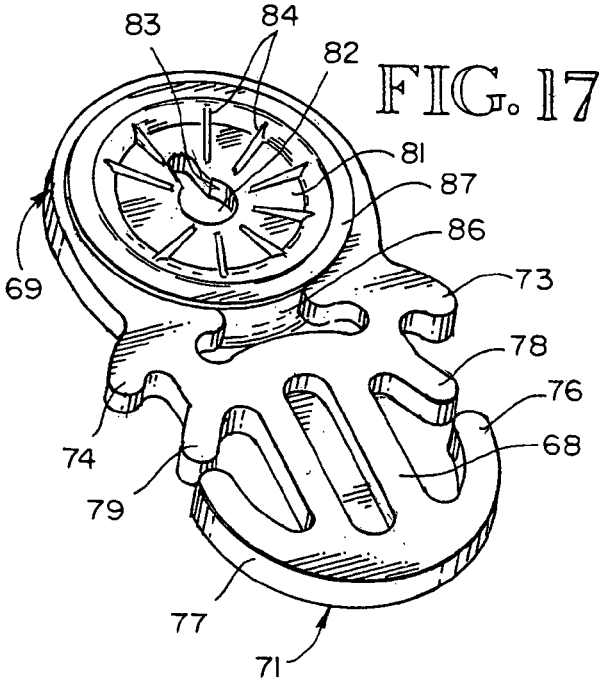
FIG. 17 is a perspective view of a third embodiment of the coupler device illustrating a removable hanger disc.
Figure 19:
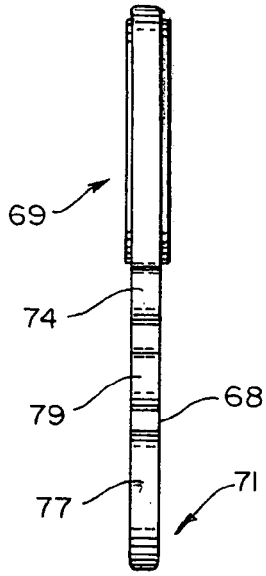
FIG. 19 is a side elevational view of the FIG. 17 embodiment.
Figure 18:
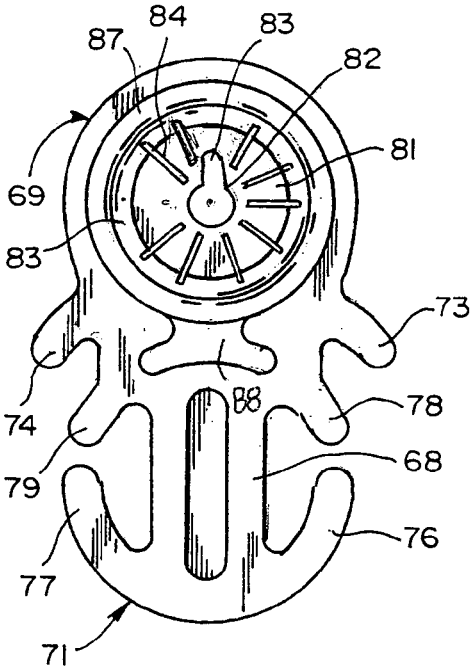
FIG. 18 is a front elevational view of the FIG. 17 embodiment.
Figure 20:
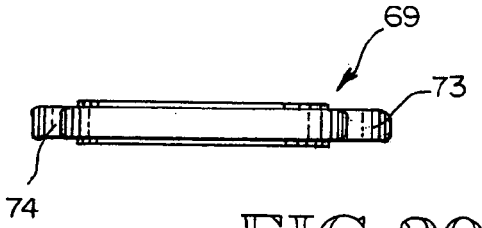
FIG. 20 is top plan view of the FIG. 17 embodiment.
Figure 21:
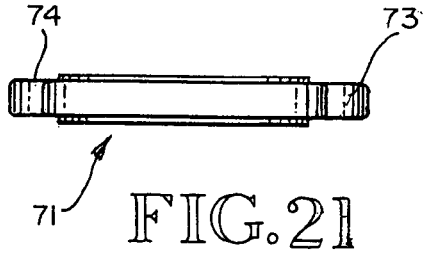
FIG. 21 is a bottom plan view of the FIG. 17 embodiment.

FIGS. 17–21 illustrate a third embodiment which is configured to receive a snap-fit adjustably positioned hanger disc. This embodiment comprises a coupler which includes the elements described previously relative to the FIGS. 1–10 embodiment. These elements include an elongated shank portion 68 having a loop ring 69 on its upper end and a double hook fastener 71, as illustrated in the drawings. The hook fastener includes hook arms 76 and 77 and the loop ring 69 is provided with bosses 73 and 74 which correspond in function to the bosses 13 and 14 of FIGS. 1–10 embodiment. Likewise the shank 68 is provided with keeper arms 78 and 79 corresponding in function to the keeper arms 18 and 19 of the FIGS. 1–10 embodiment. It will be understood that the functions of the loop ring 69 and bosses 73 and 74 as well as the double hook fastener 71 and keeper arms 78 and 79 are identical to the functions described for the corresponding elements in the FIGS. 1–10 embodiment for the purpose of securing the opposite ends of an elastic band used to encircle the items to be held. In addition to these elements and the attendant functions described, the FIGS. 17–21 embodiment includes a removable hanger disc 81 which is adapted for mounting within the center of the ring 69 as shown in FIGS. 17 and 18. The purpose of the hanger disc is to adapt the ring for hanging storage on a protruding nail, screw or the like having a headed terminal end. As shown in FIGS. 17 and 18 the disc 81 has a central opening comprising an enlarged circular passage 82 for accepting the head of a nail or screw and a slotted opening 83 on its periphery for receiving the shank of a hanger element. This configuration is, of course, well known and serves to engage the head of a hanger element so as to prevent removal of the coupler without aligning the head of the hanger element with the central opening 82. The hanger disc 81 may be a thin bodied disc with reinforcements such as the gussets 84. In the alternative, the hanger disc may be simply a flat disc. The outer periphery of the disc 81 is configured to conform to the periphery of the opening in the ring 69 and may be received and releasably held in the opening by a snap-fit in any well known manner. In the present embodiment, the peripheral edge of the disc 81 includes an annular depression 86 flanked by relatively thin peripheral flanges 87 shown in FIG. 17. In order to better accommodate the inner disc, the body of the ring 69 may be made suitably flexible to provide the snap-fit and/or be provided with a cut-away such as shown at 88 to enhance the flexibility of that portion of the coupler.

Although the present preferred embodiments have been described in terms of certain specific structures and configurations, it will be apparent to those skilled in the art that many variations and modifications are possible. For instance, the relative dimensions of the various elements of the coupler as well as their specific configurations may be modified while maintaining the described functions of these elements without departing from the scope or intent of the invention. Likewise, the cross sections of the various elements may be altered from that illustrated in the drawings and the specific materials utilized in constructing the coupler may be varied to accommodate the required design flexibility and strength of the coupler. It will also be understood that the strap element of the assembly may be made from various materials and may either be an elastomer or a non-stretchable material. It is to be understood that the preceding description is given merely by way of illustration and not limitation.

What is claimed is:

1. A tie strap assembly comprising:

a flexible tie strap for encircling articles to be bound, said strap including attaching loop sections on opposite ends thereof, and a coupler device connecting to the loop sections of said strap, said coupler device comprising a coupler body including;

an elongated shank, an enlarged head on one end of said shank comprising a closed ring having an open central area and an outer peripheral surface, a double hook at the opposite end portion of said shank, keeper arms extending laterally downwardly in opposite directions from said shank between said head and said double hook and including terminal ends closely adjacent the terminal ends of said double hook for guiding and restraining one loop section of said tie strap in engagement with said double hook, said head, said keeper arms and said double hook being substantially coplanar, and a boss protruding laterally from each of the opposite sides of the outer peripheral surface of the ring and positioned to restrain the other loop section of said tie strap in position in engagement therewith and the outer peripheral surface of said ring, whereby the open central area of said ring defines a structure for hanging the tie strap assembly and articles encircled thereby in a storage position.

2. The tie strap assembly of claim 1 wherein said double hook comprises oppositely extending hook arms directed laterally and upwardly toward to said closed ring.

3. The tie strap assembly of claim 2 wherein said hook arms are curved upwardly and said keeper arms are curved downwardly in the direction of said double hook.

4. The tie strap assembly of claim 3 wherein said ring has a diametric cross axis normal to the longitudinal axis of said shank, each said bosses being located on or below said cross axis.

5. The tie strap assembly of claim 4 wherein said bosses are directed outwardly and downwardly toward said keeper arms.

6. The tie strap assembly of claim 5 wherein said coupler device is formed from molded plastic in a monolithic mass.

7. A tie strap assembly comprising:

a flexible tie strap for encircling articles to be bound, said strap including attaching loop sections on opposite ends thereof, and a coupler device for connecting to the loop sections of said strap, said coupler device comprising a coupler body including;

an elongated shank, an enlarged head on one end of said shank comprising a closed ring having an open central area, a first set of bosses protruding laterally from each of the opposite sides of said ring, a second set of bosses protruding laterally from each of the opposite sides of said ring and circumferentially spaced respectively from said first set of bosses, a double hook at the opposite end portion of said shank, keeper arms extending laterally downwardly in opposite directions from said shank between said head and said double hook with terminal ends closely adjacent the terminal ends of said double hook for guiding and restraining one loop section of said tie strap in engagement with said double hook, said head, said hook and said keeper arms being substantially coplanar, at least one said sets of bosses positioned to restrain the other loop section of said tie strap in position in engagement therewith, a cleat member extending upwardly from the top center portion of said ring and located between said second set of bosses, at least one lug protruding laterally from said double hook for attachment of one loop section of said tie strap, and said coupler body having a first side surface for contacting a support wall surface in a first use mode and contacting articles to be bound in a second use mode, the opposite side surface of said coupler body contacting articles to be bound in said first use mode, whereby said tie strap may be connected to the coupler head, encircle articles to be bound and connected to said double hook in the second use mode and connected to said cleat member, encircle articles to be bound and connected to said at least one lug in the first use mode.

8. The tie strap assembly of claim 7, including an article support protruding from said opposite side surface of said coupler body for assisting support of the articles to be bound in said first use mode.

9. The tie strap assembly of claim 8 wherein said cleat member is spaced from the first side surface of said coupler to accommodate attachment of one loop section of said tie strap thereto.

10. The tie strap assembly of claim 9 wherein said coupler device is formed from molded plastic in a monolithic mass.

11. A tie strap assembly comprising;

a flexible tie strap for encircling articles to be bound, said strap including attaching loop sections on opposite ends thereof, and a coupler device for connecting to the loop sections of said strap, said coupler device comprising a coupler body including;

an elongated shank, an enlarged coupler head on one end of said shank comprising a semi rigid closed ring having an open central area, said central area having a first peripheral wall surface with a circumferential break therein and a second peripheral wall surface communicating with said first peripheral wall surface and defining a material relief section in the coupler head to increase the flexibility thereof, a removable hanger disc having a peripheral surface conforming to the first peripheral wall surface of said central area and adapted to be received therein with a snap fit, said hanger disc including means for receiving a hanger support for supporting said tie strap assembly and the articles bound thereby, a double hook at the opposite end portion of said shank, keeper arms extending laterally from said shank between said coupler head and said double hook for guiding and restraining one loop section of said tie strap in engagement with said double hook, and at least one boss protruding from said head and positioned to restrain the other loop section of said tie strap in position in engagement therewith.

12. The tie strap assembly of claim 11 wherein said coupler device is formed from molded plastic in a monolithic mass.

13. A tie strap assembly comprising:

a flexible tie strap for encircling articles to be bound, said strap including attaching loop sections on opposite ends thereof, and a coupler device for connecting to the loop sections of said strap, said coupler device comprising a coupler body including;

an elongated shank, an enlarged coupler head on one end of said shank comprising a closed ring having an open central area defined by an inside surface, and a removable mounting disc located within said open central area and including lug means for connecting the coupler device to a carrier vehicle, said mounting disc being connected to the inside surface of said ring with at least one frangible connector, a double hook at the opposite end portion of said shank, keeper arms extending laterally from said shank between said head and said double hook for guiding and restraining one loop section of said tie strap in engagement with said double hook, at least one boss protruding from said head and positioned to restrain the other loop section of said tie strap in position in engagement therewith, whereby said coupler may be mounted on a carrier vehicle for storage, advertising and sale and said disc subsequently removed to render said closed ring available for hanging the strap assembly and articles encircled thereby in a storage position.

14. The tie strap assembly of claim 13 wherein said coupler device is formed from molded plastic including said mounting disc and the frangible connector associated therewith as a monolithic mass.

15. The tie strap assembly of claim 14 including;

a plurality of said frangible connector located about the periphery of said mounting disc, and a boss protruding laterally from each of the opposite sides of said ring, whereby a loop section of said tie strap may be engaged and held on the outside surface of said ring to render the closed ring available for hanging the tie strap assembly and the articles encircled thereby in a storage position.

16. A coupler for connecting the opposite ends of a flexible tie strap comprising;

a coupler body including an elongated shank, an enlarged head on one end of said shank comprising a closed ring having an open central area and an outer peripheral surface, a double hook at the opposite end portion of said shank, keeper arms extending laterally downwardly in opposite directions from said shank between said head and said double hook and including terminal ends closely adjacent the terminal ends of said double hook for guiding and restraining a tie strap in engagement with said double hook, a boss protruding laterally from each of the opposite sides of the outer peripheral surface of the ring and positioned to restrain a tie strap in position in engagement therewith and the outer peripheral surface of said ring, whereby the open central area of said ring defines a structure used to hang hanging the coupler in a storage position.

17. A coupler for connecting the opposite ends of a flexible tie strap comprising;

a coupler body including an elongated shank, an enlarged coupler head on one end of said shank comprising a closed ring having an open central area, a first set of bosses protruding laterally from each of the opposite sides of said ring, a second set of bosses protruding laterally from each of the opposite sides of said ring and circumferentially spaced respectively from said first set of bosses, a double hook at the opposite end portion of said shank, keeper arms extending laterally from said shank between said head and said double hook for guiding and restraining a tie strap in engagement with said double hook, at least one said sets of bosses protruding from said head and positioned to restrain a tie strap in position in engagement therewith, a cleat member extending upwardly from the top center portion of said ring and located between said second set of bosses, at least one lug protruding laterally from said double hook for attachment of a tie strap, said coupler body having a first side surface for contacting a support wall surface in a first use mode and contacting articles to be bound in a second use mode, the opposite side surface of said coupler body contacting articles to be bound in said first use mode, whereby a tie strap may be connected to the coupler head, encircle articles to be bound and connected to said double hook in the second use mode, and connected to said cleat member, encircle articles to be bound and connected to said at least one lug in the first use mode.

18. The coupler of claim 17 including an article support protruding from said opposite side surface of the coupler body for assisting support of articles bound in said first use mode.

19. A coupler for connecting the opposite ends of a flexible tie strap comprising;

a coupler body including an elongated shank, an enlarged coupler head on one end of said shank comprising a semi rigid closed ring having an open central area, said central area having a first peripheral wall surface with a circumferential break therein and a second peripheral wall surface communicating with said first peripheral wall surface and defining a material relief section in the coupler head to increase the flexibility thereof, and a removable hanger disc having a peripheral surface conforming to the first peripheral wall surface of said central area and adapted to be received therein with a snap fit, said hanger disc including means for receiving a hanger support for supporting said coupler, a double hook at the opposite end portion of said shank, keeper arms extending laterally from said shank between said coupler head and said double hook for guiding and restraining a tie strap in engagement with said double hook, and at least one boss protruding from said coupler head and positioned to restrain a tie strap in position in engagement therewith.

20. The coupler of claim 19 wherein said coupler device is formed from molded plastic in a monolithic mass.

21. A tie strap coupler comprising;

an elongated shank, an enlarged head on one end of said shank including means for engaging a tie strap on its outer surface and hanger means used to engage engaging a coupler support, a double hook having oppositely directed hook arms at the opposite end of said shank, keeper arms extending from said shank and having terminal ends adjacent the terminal ends of respective hook arms, said head, said keeper arms and said double hook being substantially coplanar, and at least one boss protruding from said head and positioned to restrain a tie strap engaged therewith and the outer surface of said enlarged head.

22. The coupler of claim 16 wherein;

said central area includes an inner peripheral wall surface, and a removable hanger disc having a peripheral surface conforming to said inner peripheral wall surface and adapted to be received therein with a snap fit, said hanger disc including means for receiving a hanger support for supporting said coupler.

23. The coupler of claim 16 wherein;

said central area includes an inner peripheral wall surface, and a removable mounting disc located within said open central area and including lug means for connecting the coupler to a carrier vehicle, said mounting disc being connected to the inner peripheral surface with at least one frangible connector, whereby said coupler may be mounted on a carrier vehicle for storage, advertising and sale and said disc subsequently removed to render said closed ring available for hanging and supporting said coupler.

24. A tie strap assembly comprising:

a flexible tie strap for encircling articles to be bound, said strap including attaching means on the opposite ends thereof, a tie strap coupler, said coupler comprising;

an elongated shank, an enlarged head on one end of said shank including means for engaging the attaching means on one end of said tie strap located on the outside surface of said head, a double hook having oppositely directed hook arms at the opposite end of said shank engaging the other end of said tie strap, keeper arms extending from said shank and having terminal ends adjacent the terminal ends of respective hook arms, said head, said keeper arms and said double hook being substantially coplanar, and at least one boss protruding from said head and positioned to restrain said one end of said tie strap on the outer surface of the head.

* * * * *

UNITED STATES PATENT AND TRADEMARK OFFICE

CERTIFICATE OF CORRECTION

PATENT NO. : 7,107,654 B2
APPLICATION NO. : 10/849682
DATED : September 19, 2006
INVENTOR(S) : Gary L. Byers It is certified that error appears in the above-identified patent and that said Letters Patent is hereby corrected as shown below:

Col. 10, Line 14 cancel “engaging”.

Signed and Sealed this

Third Day of April, 2007

JON W. DUDAS
*Director of the United States Patent and Trademark Office*